US006013142A

United States Patent [19]

Hacias

[11] Patent Number: 6,013,142

[45] Date of Patent: Jan. 11, 2000

[54] COMPOSITION AND PROCESS FOR PREVENTING BLISTERING DURING HEAT TREATING OF ALUMINUM ALLOYS

[75] Inventor: Kenneth J. Hacias, Sterling Heights, Mich.

[73] Assignee: Henkel Corporation, Gulph Mills, Pa.

[21] Appl. No.: 08/858,716

[22] Filed: May 19, 1997

[51] Int. Cl.[7] ..... C22F 1/04

[52] U.S. Cl. ..... 148/703; 148/697

[58] Field of Search ..... 148/697, 698, 148/703

[56] References Cited

U.S. PATENT DOCUMENTS

| | | | |
|---|---|---|---|
| 2,550,660 | 5/1951 | Amundsen et al. . | |
| 3,390,562 | 7/1968 | Rausch et al. | 72/42 |
| 4,391,655 | 7/1983 | Thurston et al. | 148/703 |
| 4,968,358 | 11/1990 | Pellman et al . | |
| 5,753,056 | 5/1998 | Opalka et al. | 148/703 |

FOREIGN PATENT DOCUMENTS

| | | |
|---|---|---|
| 1224656 | 9/1971 | United Kingdom . |
| 87 04730 | 8/1987 | WIPO . |

OTHER PUBLICATIONS

"Heat Treating of Nonferrous Alloys", American Sockety for Metals Handbook, vol. IV, Aug. 1, 1991, pp. 848, 850, 851.

Chemical Abstracts, vol. 106, No. 18, 04 May 1987, Abstract No. 142066, Seike, Norio et al.: "Flux binders for welding electrodes" XP002108051 & JP 61 238494 A (Kobe Steel, Ltd., Japan)

*Primary Examiner*—John Sheehan

*Attorney, Agent, or Firm*—Ernest G. Szoke; Wayne C. Jaeschke; Norvell E. Wisdom, Jr.

[57] ABSTRACT

Aluminum alloys that are susceptible to damage by High Temperature Oxidation during solution heat treatment are protected against such damage by a coating containing sodium fluoroborate and/or other fluorine-containing-gas-generating material. The coating can be one suitable for lubrication during cold working of the substrate and can remain in place after the cold working to protect the substrate during subsequent heat treatment.

10 Claims, No Drawings

COMPOSITION AND PROCESS FOR PREVENTING BLISTERING DURING HEAT TREATING OF ALUMINUM ALLOYS

CROSS-REFERENCE TO RELATED APPLICATIONS

Not Applicable.

STATEMENT REGARDING FEDERALLY SPONSORED RESEARCH OR DEVELOPMENT

Not Applicable

BACKGROUND OF THE INVENTION

This invention relates to a composition and process for preventing a phenomenon known as "High Temperature Oxidation" during conventional heat treatments, particularly so-called "solution" heat treatments, of certain aluminum alloys.

After casting, cold working, or any other process that can promote inhomogeneous segregation of certain constituents of aluminum alloys, solid objects made of these alloys are often "solution" heat treated at temperature(s), between about 475 and 545° C., that are believed to cause rehomogenization of all of the constituents of the alloy in a solid solution. This process is usually performed in a molten salt bath or in an air furnace, with the latter more commonly used because it is less expensive. When the objects treated are made of aluminum alloys of the 2000, 6000, and 7000 series and are treated in an air furnace, they are susceptible to the development of surface blisters, a very undesirable condition commonly known as "high temperature oxidation". It is known that this phenomenon is aggravated by the presence of water vapor and/or sulfur in the gaseous atmosphere surrounding the objects being heat treated. It is further known that high temperature oxidation can sometimes be prevented by including an open container of fluoroborate salt(s) in the same air furnace in which the heat treating is occurring. However, sometimes this method is ineffective, and even when it is effective in preventing high temperature oxidation, it also promotes a normally undesirable staining or darkening of the objects being heat treated. Furthermore, the effects of fluoroborate salt(s) can not be quickly removed from the gaseous atmosphere in the furnace by any known practical method, so that subsequent objects being processed, which may not be susceptible to high temperature oxidation and may need a bright surface, can be damaged by this treatment. Finally, the amount of fluoroborate salt(s) to be used must be carefully controlled, and an effective amount must be established by trial-and-error for each individual furnace, an obviously undesirable situation.

A major object of this invention is to prevent high temperature oxidation of aluminum alloy objects while avoiding or at least mitigating the undesirable features of current processes as described above. Another alternative or concurrent object is to achieve these improvements at minimum economic cost. Other objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred, however. Also, throughout the specification, unless expressly stated to the contrary:

percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation within the combination, from one or more other material(s) added to the combination by chemical reaction(s) noted in the description that are known or believed to occur between or among specific newly added constituent(s) and other constituent(s) already present in the combination, and does not necessarily preclude unspecified chemical interactions among the constituents of a mixture once mixed; specification of materials in ionic form implies the presence of sufficient counterions to produce electrical neutrality for the composition as a whole; any counterions thus implicitly specified should preferably be selected from among other constituents explicitly specified in ionic form, to the extent possible; otherwise such counterions may be freely selected, except for avoiding counterions that act adversely to the object(s) of the invention; the terms "molecule" and "mole" and their grammatical variations may be applied to ionic, elemental, or any other type of chemical entities defined by the number of atoms of each type present therein, as well as to substances with well-defined neutral molecules; the first definition of an acronym or other abbreviation applies to all subsequent uses herein of the same abbreviation and applies mutatis mutandis to normal grammatical variations of the initially defined abbreviation; the term "paint" includes all like materials that may be designated by more specialized terms such as lacquer, enamel, varnish, shellac, and the like; and the term "polymer" includes "oligomer", "homopolymer", "copolymer", "terpolymer", and the like.

BRIEF SUMMARY OF THE INVENTION

It has been found that the objects of the invention can be achieved more effectively than with any prior art methods by steps of: (I) coating the surface of a substrate at a coating temperature with a liquid containing a combination of (i) a material that is chemically stable and non-reactive with any of the constituents of the liquid at the coating temperature but that, in isolation, releases a fluorine-containing gas at the heat treatment temperature and (ii) a binder material, so as to form an adherent liquid layer over the substrate; (II) forming a solid coated substrate by drying the liquid layer formed in step (I), while it remains in place over the substrate, to produce from said liquid layer an adherent solid coating, at least part of which will not melt, soften, and/or decompose at the temperature of heat treating so much as to spontaneously eliminate contact between the surface of the substrate and at least one of a solid or a liquid phase derived from said adherent solid coating; (III) forming a coated and heat treated substrate by bringing the solid coated substrate produced in step (II) to the selected heat treatment temperature; and (IV) cooling the coated and heat treated substrate produced in step (III), with at least one of a liquid and a solid phase derived from said adherent solid coating still in direct contact with the surface of the substrate, to a temperature at which the substrate is no longer susceptible to High Temperature Oxidation when in contact with the ambient natural atmosphere.

Embodiments of the invention include: liquid working compositions for use as described in the preceding paragraph; concentrates, concentrated compositions, or concentrate compositions, all of which terms are considered equivalent herein, which are suitable for dilution with water to form working compositions according to the invention; compositions which are suitable for use either as working compositions or as concentrates; dried compositions produced from the liquid working compositions by drying them; processes as described in the immediately preceding paragraph, which may also be expanded to include other steps, including steps conventional per se; and articles coated with liquid and/or dried compositions according to the invention.

BRIEF DESCRIPTION OF THE SEVERAL VIEWS OF THE DRAWING

Not Applicable.

DETAILED DESCRIPTION OF THE INVENTION

For a variety of reasons, almost always including that of the economy of eliminating the cost of an unneeded ingredient in a composition, compositions according to this invention, with increasing preference in the order given and with independent preference for each noted component, preferably contain no more than 4, 2.5, 1.5, 0.90, 0.70, 0.50, 0.30, 0.20, 0.12, 0.070, 0.040, 0.030, 0.020, 0.010, 0.0070, 0.0040, 0.0020, 0.0010, or 0.00050 grams, per kilogram of the total composition, (hereinafter usually abbreviated as "g/kg") of each of the following constituents: any metal cations that have a valence of two or more and are present in stoichiometric excess over that necessary to form salts with all of the organic carboxylic acid(s) present in the composition, such acids that may have been added to the composition not being considered to be present as acids in the composition to the extent that it is stoichiometrically possible for them to form salts with any monovalent metal oxide or hydroxide that has previously been added to the composition; chlorine, bromine, or iodine atoms in any chemical form; nitrogen atoms in any inorganic chemical compound; sulfate ions; nitroaromatic organic compounds; and anions containing any of the elements silicon, aluminum, titanium, molybdenum, zirconium, hafnium, chromium, and manganese.

A particularly useful and therefore preferred type of binder for a composition according to this invention is one that is suitable as a lubricant for non-cutting cold working of the aluminum substrate by a process that involves sliding contact between the lubricant coated surface of the aluminum substrate and another solid object. A particular example of such a process is the drawing of tubing and solid round bars of metal to reduce their cross-sectional area while correspondingly elongating them. Thus binders of this type include, but are not limited to, those lubricant compositions described and/or claimed in U.S. Pat. Nos. 5,547,595 of Aug. 20, 1996 to Hacias, 5,531,912 of Jul. 2, 1996 to Church et al., 5,368,757 of Nov. 29, 1994 to King, 4,517,029 of May 14, 1985 to Sonoda et al. (Column 4 line 57 through column 5 line 11 only), 4,289,547 of Sep. 15, 1981 to King et al., 4,289,546 of Sep. 15, 1981 to Hacias, 4,199,381 of Apr. 22, 1980 to Nuss et al., 4,197,340 of Apr. 8, 1980 to Brown et al., 3,932,287 of Jan. 13, 1976 to Schneider, 3,869,894 of Mar. 11, 1975 to Meyer et al., 3,836,467 of Sep. 17, 1974 to Jones, 3,556,996 of Jan. 19, 1971 to Jones et al., 3,556,867 of Jan. 19, 1971 to Glasson, 3,525,651 of Aug. 25, 1970 to Smith et al., 3,459,604 of Aug. 5, 1969 to Freeman et al., 3,454,495 of Jul. 8, 1969 to Schneider, 3,392,117 of Jul. 9, 1968 to Glasson, 3,390,570 of Jul. 2, 1968 to Freeman et al., 3,390,562 of Jul. 2, 1968 to Rausch et al., 3,372,117 of Mar. 8, 1968 to Jones et al., 3,313,729 of Apr. 11, 1967 to Glasson, 3,313,728 of Apr. 11, 1967 to Glasson et al., 3,192,615 of Jul. 6, 1965 to Rausch et al., 2,672,976 of Mar. 23, 1954 to Overath et al., and 2,550,660 of May 1, 1951 to Amundsen et al.; the entire disclosures of which, except for any matter contrary to any explicit statement herein, are all incorporated herein by reference.

A particularly preferred example of this type of binder for use in the invention comprises, preferably consists essentially of, or more preferably consists of:

(A) an amount of a component of alkali metal salt(s) of organic monocarboxylic aliphatic acids having from 10 to 22 carbon atoms per molecule;

(B) an amount of a component of alkaline earth metal salt(s) of monocarboxylic aliphatic acids having from 10 to 22 carbon atoms per molecule; and (C) an amount of a component of salt(s) of inorganic acids containing boron, oxygen, and hydrogen as sole elemental constituents;

and, optionally, one or more of the following components:

(D) an amount of a component of free monocarboxylic aliphatic acids having from 10 to 22 carbon atoms per molecule;

(E) water, (F) pH adjusting materials that are not part of any of the previously recited components;

(G) odorant(s) that are not part of any of the previously recited components; and (H) colorant(s) that are not part of any of the previously recited components.

Independently for each above-noted component that includes monocarboxylic aliphatic acids or salts thereof, said monocarboxylic aliphatic acids preferably have at least, with increasing preference in the order given, 12, 13, 14, 15, 16, 17 or 18 carbon atoms per molecule and independently preferably have not more than, with increasing preference in the order given, 22, 20, 19, or 18 carbon atoms per molecule. The acid molecules may be straight-chain or branched, preferably the former, and independently may be saturated or unsaturated, preferably the former.

Any of the above noted salts of monocarboxylic aliphatic acid(s) may be provided to a composition according to the invention by reaction in situ between a monocarboxylic acid and an oxide or hydroxide of the metal desired as counterions in these salts. This method is particularly convenient, and therefore preferred, for supplying those salts, including some of the most preferred ones, that have very low solubility in water.

Component (A) preferably comprises sodium salts, and it more preferably comprises, still more preferably consists essentially of, or yet more preferably consists of, both sodium and lithium salts in a molar ratio of lithium to sodium that is at least, with increasing preference in the order given, 0.010:1.0, 0.020:1.0, 0.040:1.0, 0.080:1.0, 0.10:1.0, 0.12:1.0, 0.14:1.0, 0.150:1.0, 0.160:1.0, 0.170:1.0, 0.180:1.0, or 0.190:1.0 and independently preferably is not more than, with increasing preference in the order given, 2.0:1.0, 1.5:1.0, 1.0:1.0, 0.5:1.0, 0.40:1.0, 0.35:1.0, 0.30:1.0, 0.27:1.0, 0.24:1.0, or 0.21:1.0.

In a concentrate composition according to the invention, the amount of sodium salt(s) from component (A) preferably is at least, with increasing preference in the order given, 20, 40, 80, 120, 180, 220, 250, 275, or 285 g/kg and independently preferably is not more than, with increasing preference in the order given, 600, 540, 480, 430, 390, 350, 320, 300, or 290 g/kg. Independently, in a working composition according to the invention, the amount of sodium salt from component (A) preferably is at least, with increasing preference in the order given, 3, 5, 9, 13, 17, 21, 23, 25, 27, 29, 31, or 33 grams per liter of total composition (hereinafter usually abbreviated as "g/gL") and independently preferably is not more than, with increasing preference in the order given, 250, 200, 150, 120, 100, 80, 70, 60, 50, 45, 40, or 35 g/L.

Calcium salts are most preferred for component (B), and independently the number of moles of carboxylate anions furnished by component (B) preferably has a ratio to the number of moles of carboxylate anions furnished by component (A) that is at least, with increasing preference in the order given, 0.030:1.0, 0.060:1.0, 0.10:1.0, 0.12:1.0, 0.14:1.0, 0.16:1.0, 0.18:1.0, 0.20:1.0, 0.22:1.0, 0.24:1.0, or 0.26:1.0 and independently preferably is not more than, with increasing preference in the order given, 2.0:1.0, 1.6:1.0, 1.2:1.0, 0.80:1.0, 0.70:1.0, 0.60:1.0, 0.50:1.0, 0.40:1.0, 0.37:1.0, 0.33:1.0, 0.31:1.0, or 0.29:1.0.

Although the invention is not to be considered limited by theory, it is believed that the above-stated preferences for three distinct types of carboxylate salts arise from the varying lubricating properties of the types of salts described. Sodium salts of the most preferred carboxylic acids, particularly sodium stearate, are the lowest melting of the three types specified and are relatively soluble in water. In contrast, alkaline earth metal, especially calcium and magnesium, salts of these most preferred acids such as stearic acid are notoriously low in water solubility (they constitute most of the "scum" formed by use of soap in hard water) and are also higher melting, so that they likely remain solid even under severe cold forming conditions. Lithium salts are intermediate between sodium and alkaline earth metal salts in both water solubility and melting point. A dispersion of these lubricative solids in liquefied or at least softened sodium carboxylate salts thus is likely to be formed from the most preferred salt combinations under cold working conditions and to provide desirable lubrication during that process.

Component (C) may be selected from any of the borate and condensed borate salts that are sufficiently water soluble. Primarily for reasons of economy, sodium tetraborate is most preferred. Independently, the amount of component (C) preferably is such that its stoichiometric equivalent as boron atoms has a ratio to the content of component (A) in the same composition that is at least, with increasing preference in the order given, 0.005:1.0, 0.010:1.0, 0.020:1.0, 0.030:1.0, 0.035:1.0, 0.038:1.0, 0.041:1.0, 0.044:1.0, 0.046:1.0, 0.048:1.0, or 0.050:1.0 and independently preferably is not more than 0.40:1.0, 0.30:1.0, 0.25:1.0, 0.20:1.0, 0.16:1.0, 0.13:1.0, 0.10:1.0, 0.080:1.0, 0.070:1.0, 0.060:1.0, or 0.055:1.0. The function of the boron derived from component (C) and the reasons for the stated preferred ratio to the amount of component (A) are not known in any detail, but the presence of this component nevertheless has advantageous lubricative properties that appear not to be substantially diminished by the addition of the fluoride containing additive that is particularly characteristic of this invention.

Among the optional components, the presence of free carboxylic acid component (D) and of water in a composition according to the invention is generally preferred. Free carboxylic acid is useful as a safeguard against any unwanted strong alkalinity that might be introduced by the borate salts in component (C) or by unplanned excesses of alkali that might result if it was attempted, without sufficiently precise control, to supply part of components (A) and/or (B) by exactly neutralizing the entire content of carboxylic acid originally added to the composition along with one or more metal oxides or hydroxides also added to the composition. Free carboxylic acid also affects the viscosity of the composition, thereby affecting the thickness of the coating formed, and may well also contribute specifically useful lubricity properties on its own. The molar ratio of free carboxylic acid to carboxylate anions in components (A) and (B) in a composition according to the invention preferably is at least 0.0010:1.0, 0.0020:1.0, 0.0030:1.0, 0.0040:1.0, 0.0050:1.0, 0.0060:1.0, 0.0070:1.0, 0.0080:1.0, 0.0090:1.0, 0.0100:1.0, 0.0110:1.0, 0.0115:1.0, 0.0120:1.0, or 0.0125:1.0 and independently preferably is not more than, with increasing preference in the order given, 0.30:1.0, 0.20:1.0, 0.10:1.0, 0.080:1.0, 0.060:1.0, 0.040:1.0, 0.030:1.0, 0.025:1.0, 0.020:1.0, 0.017:1.0, 0.015:1.0, or 0.013:1.0.

Preferred working compositions according to the invention have a free acid content that is at least, with increasing preference in the order given, 0.5, 1.0, 1.3, 1.6, 1.9, 2.1 or 2.3 points and independently preferably is not more than, with increasing preference in the order given, 5.0, 4.5, 4.0, 3.5, 3.3, 3.1, or 2.9 points. Points of free acid are measured by titrating a 10 milliliter sample of the composition, dissolved in water with some isopropyl alcohol added if needed to solubilize the entire contents, with 0.1 N sodium hydroxide solution in water to a faint pink end point with phenolphthalein indicator, the number of points is defined to equal the number of milliliters of the 0.1 N sodium hydroxide solution required for this titration. Ordinarily in a freshly prepared composition according to the invention with the most preferred values of free carboxylic acid specified above, preferred values of free acid points will be automatically achieved. If they are not, however, or if the free acid points value of a composition changes during use to a value outside the preferred range, the value preferably is readjusted by adding acidic or alkaline pH adjusting materials, optional component (F) as described above, as appropriate for the direction in which the free acid points value should be changed.

Water is normally preferred in a concentrate composition according to the invention and is almost always preferred in a working composition according to the invention, to assist in making the working composition liquid at the time of application. Any balance of any particular composition according to the invention that is not specified herein to be some other material normally is preferably water.

The remaining above-noted optional components, odorants and colorants, in the binder of a composition according to this invention have no known technical function in the invention, but may be added to compositions according to the invention for marketing and/or process control reasons: Color can be helpful in estimating the degree of coverage achieved with a composition, and some of the necessary ingredients may have unpleasant odors that can be masked by an odorant. In part because of tradition in the industry, for example, pine oil is often preferably present in compositions according to the invention, preferably at a level of about 5 g/kg of a concentrate or 0.6 g/L in a working composition.

In addition to a binder, which as noted above is often conventional in itself, a composition according to this invention also necessarily and characteristically contains a fluorine containing material. This fluorine containing material is stable at the temperature of coating used or expected to be used with the composition in a process according to the invention, or if this temperature is unknown, at a temperature of 100° C., but this same fluorine containing material, if exposed in isolation in a chemically inert container defining a closed space substantially free from other materials (except the container walls) at the temperature of heat treating that is used or expected to be used in a process according to the invention, or to a temperature of 500° C. if the temperature of intended use is not known, produces at least one fluorine containing gas. It should be noted that this does not necessarily mean that any such fluorine containing gas must be liberated from a dried composition according to the invention in place on an aluminum substrate, because in such an instance the fluorine-containing-gas-generating material is in contact with other materials, with at least one of which there may occur a chemical reaction that supersedes or prevents the physico-chemical process(es) that lead to gas generation during exposure of the same fluorine-containing-gas-generating material to the same temperature in a closed evacuated space.

Preferably, the fluorine-containing-gas-generating material, when confined within a closed space substantially free from all other materials at 529° C., generates a partial pressure of fluorine containing molecules in the gaseous state that is at least, with increasing preference in the order given, 0.002, 0.005, 0.010, 0.020, 0.040, 0.060, 0.080, 0.10, or 0.12 bar and independently preferably is not more than, with increasing preference in the order given, 10, 5, 3, 2.0, 1.0, 0.80, 0.60, or 0.40 bar(s).

A wide variety of suitable fluorine containing materials are available for this purpose. For example, most acid fluoride salts will decompose to yield gaseous hydrogen fluoride, and most fluoroborate and hydroxyfluoroborate salts will decompose to yield gaseous boron trifluoride. The most preferred material for the fluorine-containing-gas-generating material in a composition according to this invention is sodium fluoroborate, which is relatively safe and inexpensive and appears to be highly effective in the desired temperature range for solution heat treating aluminum alloys. According to an equation in the literature[1], this compound has a partial pressure of $BF_3$ of 0.16 bar in equilibrium with it at 529° C. and a partial pressure of 0.11 bar in equilibrium with it at 500° C.

[1]*Encyclopedia of Chemical Technology*, 3rd Ed. (John Wiley & Sons, New York, 1980), Vol. 10, p. 698, which is hereby incorporated herein by reference.

The amount of fluorine-containing-gas-generating material needed in a working composition according to the invention in order to work effectively is surprisingly small. Primarily for reasons of economy, the stoichiometric equivalent as fluorine of the content of the fluorine-containing-gas-generating material in a composition according to the invention preferably is such as to have a ratio to the amount of components (A) and (B) in the same composition that is not more than, with increasing preference in the order given, 0.10:1.0, 0.050:1.0, 0.025:1.0, 0.012:1.0, 0.010:1.0, 0.0080:1.0, 0.0060:1.0, 0.0050:1.0, 0.0040:1.0, 0.0035:1.0, 0.0030:1.0, or 0.0027:1.0. Independently, in order to achieve a commercially valuable degree of inhibition of high temperature oxidation, this ratio preferably is at least, with increasing preference in the order given, 0.0002:1.0, 0.0004:1.0, 0.0006:1.0, 0.0008:1.0, 0.0010:1.0, 0.0013:1.0, 0.0016:1.0, 0.0019:1.0, 0.0021:1.0, 0.0023:1.0, or 0.0025:1.0.

Processing conditions for a process according to the invention are preferably the same as are known in the art for the binder composition and the particular type of aluminum being treated. Thus, for example, for the most preferred binder compositions as described above, a substrate that is to be cold worked is preferably cleaned and provided with a dried calcium aluminate conversion coating, e.g., by use of BONDERITE® 770X materials as recommended by their supplier, Henkel Surface Technologies division of Henkel Corporation, to act as a carrier for the lubricant coating, before being brought into contact with a working composition according to the invention, which functions normally as a lubricant for any cold working operation to which the coated substrate may be subjected. After any cold working is complete, the still coated substrate is then normally solution heat treated to assure rehomogenization of the microstructure of the substrate. During this stage, the coating functions to protect the underlying substrate against high temperature oxidation. After heat treatment and quenching, the coating can be conventionally removed.

The most preferred compositions according to the invention as described above are preferably applied by immersion, independently preferably while the composition is maintained at a temperature that is at least, with increasing preference in the order given, 35, 40, 45, 50, 55, 60, 65, 70, or 75° C. and independently preferably, primarily for reasons of economy, is not more than 105, 100, 97, 94, 91, 89, 87, 85, or 83° C. The total amount of dried composition according to the invention added on to the previous coatings during this step is largely determined by the porosity of the underlying coating. If this underlying coating is a preferred conventional calcium aluminate conversion coating, the mass of dried coating added on per unit area coated preferably is at least, with increasing preference in the order given, 1, 3, 4.0, 5.0, 6.0, 7.0, or 8.0 grams of dried coating per square meter of surface coated (hereinafter usually abbreviated as "$g/m^2$") and independently, primarily for reasons of economy, preferably is not more than, with increasing preference in the order given, 100, 75, 50, 45, 40, 35, 30, 25, 20, 18, 16, 14, or 12 $g/m^2$. The coating mass preference is largely determined by the cold working conditions, and any mass within this preferred range is normally effective to achieve a high degree of protection against high temperature oxidation for the underlying substrate.

When the binder composition contains substantial amounts of stearates, as do the most preferred compositions according to the invention, and the substrate is to be cold worked before heat treatment, drying should be controlled so that the underlying metal reaches a temperature no higher than 176° C., in order to avoid reducing the lubricant effectiveness of the coating. Otherwise, the drying temperature is not believed to have great influence on the effectiveness of the invention, so long as the composition according to the invention is thoroughly dried before the surface on which it is applied is cold worked. Ordinarily, to promote drying at a practical speed, the temperature during drying preferably is at least, with increasing preference in the order given, 100, 110, 120, 130, 140, or 145° C. and independently, primarily for reasons of economy, preferably is not more than, with increasing preference in the order given, 175, 170, 165, 160, 155, or 150° C.

Although this invention is particularly efficiently used in connection with lubrication for cold drawing as described above, it is not restricted to such uses and may also advantageously be applied to protecting aluminum objects against high temperature oxidation, even if they are not to be cold worked at all.

Further appreciation of the present invention may be had from considering the following examples and comparative examples which are intended to illustrate, but not limit, the invention.

One conventional lubricant working composition consists of the following ingredients other than water in solution and/or dispersion in water: 34 g/L of sodium stearate, generated in situ by reaction between sodium hydroxide and a grade of technical stearic acid reported by its supplier to consist of 95% stearic acid and 5% palmitic acid; 13 g/L of lithium stearate, added as such; 25 g/L of calcium stearate, generated in situ by reaction between calcium hydroxide and the same grade of technical stearic acid as was reacted with sodium hydroxide; an amount of borax (i.e., $Na_2B_4O_7.10H_2O$) that corresponds stoichiometrically to 2.4 g/L of boron; 1.3 g/L of free stearic acid, remaining as stoichiometric excess from the total amount of technical stearic acid added over the part of it that was consumed by reaction with sodium and calcium hydroxides as noted above; and 0.6 g/L of YARMOR™ 302 pine oil, commercially supplied by Hercules, Inc. and reported by its supplier to be a natural product of mixed terpene alcohols and hydrocarbons, primarily α-terpineol. This composition served as a comparison example for a composition according to the invention that was made by adding 0.26 g/L of sodium fluoroborate (i.e., $NaBF_4$) to the comparison example composition.

Preformed drive shaft yokes constructed of Type 6061 aluminum alloy and ingots of Type 2014 aluminum alloy were provided with a conventional initial calcium aluminate conversion coating, which was dried and then coated by immersion for 3 to 5 minutes in either the above noted composition according to the invention or the above noted comparison composition. For both compositions, the temperature was maintained at 76° C. The substrates were then removed from the coating compositions, conventionally dried, and placed in a muffle furnace commercially used for solution heat treating of these aluminum alloys. The gaseous atmosphere in this furnace was already contaminated with moisture and sulfur. The temperature in the furnace was maintained at 529° C. for the 6061 alloy and at 502° C. for the 2014 alloy. Sample coated objects were removed for examination after 140 minutes or 280 minutes of heat treating at these temperatures. In both instances, the alloy pieces coated with the comparison composition had several readily visible blisters on their surfaces after 140 minutes and had surfaces that were severely blistered overall after 280 minutes, while the pieces protected with a coating according to the invention had no blisters after 140 minutes and only a few small blisters after 280 minutes. The advantage of treatment according to the invention is very clear in these comparisons.

The invention claimed is:

1. A process for heat treating, at a selected heat treatment temperature, a solid substrate constituted of an aluminum alloy that is solid but is susceptible to High Temperature Oxidation at the heat treatment temperature when in direct contact with a gaseous atmosphere containing water vapor, sulfur, or both, said process comprising steps of:

(I) coating the surface of the solid substrate at a coating temperature with a liquid containing a combination of (i) a material that is chemically stable and non-reactive with any of the constituents of the liquid at the coating temperature but that, in isolation, releases a fluorine-containing gas at the heat treatment temperature and (ii) a binder material, so as to form an adherent liquid layer over the substrate;

(II) forming a solid coated substrate by drying the liquid layer formed in step (I) while it remains in place over the substrate, to produce from said liquid layer an adherent solid coating, at least part of which will not melt, soften, and/or decompose at the temperature of heat treating so much as to spontaneously eliminate contact between the surface of the substrate and at least one of a solid or a liquid phase derived from said adherent solid coating;

(III) forming a coated and heat treated substrate by bringing the solid coated substrate produced in step (II) to the selected heat treatment temperature; and (IV) cooling the coated and heat treated substrate produced in step (III), while at least one of a liquid and a solid phase derived from said adherent solid coating remains in direct contact with the surface of the substrate, to a temperature at which the substrate is no longer susceptible to High Temperature Oxidation when in contact with the ambient natural atmosphere.

2. A process according to claim 1, wherein the liquid used in step (I) comprises:

(i) an amount of a component of fluorine-containing-gas-generating material that when tested in isolation at 529° C. is in equilibrium with a total partial pressure from about 0.01 to about 5 bars of one or more fluorine containing gases;

(ii.A) an amount of a component of alkali metal salt(s) of organic monocarboxylic aliphatic acids having from 10 to 22 carbon atoms per molecule;

(ii.B) an amount of a component of alkaline earth metal salt(s) of monocarboxylic aliphatic acids having from 10 to 22 carbon atoms per molecule; and (ii.C) an amount of a component of salt(s) of inorganic acid(s) containing boron, oxygen, and hydrogen as its sole elemental constituents, and, in said liquid used in step (I), the amount of fluorine-containing-gas-generating material has a ratio to a sum of the amounts of components (ii.A) and (ii.B) that is from about 0.0008.1.0 to about 0.10:1.0 and there are from about 1.0 to about 4.0 points of free acid.

3. A process according to claim 2, wherein the liquid used in step (I) comprises:

(i) an amount of a component of fluorine-containing-gas-generating material that, when tested in isolation at 529° C., is in equilibrium with a total partial pressure from about 0.01 to about 3 bars of one or more fluorine containing gases;

(ii.A.1) an amount, constituted of distinct amounts of sodium cations and carboxylate anions, that is from about 13 to about 120 g/l of a component of sodium salt(s) of organic monocarboxylic aliphatic acids having from 10 to 22 carbon atoms per molecule;

(ii.A.2) an amount, constituted of distinct amounts of lithium cations and carboxylate anions, of a component of lithium salt(s) of organic monocarboxylic aliphatic acids having from 10 to 22 carbon atoms per molecule, said amount of a component of lithium salts having a molar ratio to the amount of sodium salts recited in part (ii.A.1) above that is from about 0.080:1.0 to about 1.0:1.0;

(ii.B) an amount, constituted of distinct amounts of calcium cations and carboxylate anions, of a component of calcium salt(s) of monocarboxylic aliphatic acids having from 10 to 22 carbon atoms per molecule, said amount of carboxylate anions in said calcium salts having a ratio to a total of the carboxylate anions amounts of components (ii.A.1) and (ii.A.2) that is from about 0.10:1.0 to about 0.80:1.0; and (ii.C) an amount, having a stoichiometric equivalent as boron atoms, of a component of salt(s) of inorganic acids containing boron, oxygen, and hydrogen as sole elemental constituents, said stoichiometric equivalent as boron atoms of said amount having a ratio to a sum of the amounts of components (ii.A.1) and (ii.A.2) that is from about 0.020:1.0 to about 0.40:1.0, and, in said liquid used in step (I), the amount of fluorine-containing-gas-generating material has a ratio to a sum of the amounts of components (ii.A) and (ii.B) that is from about 0.0010:1.0 to about 0.05:1.0 and there are from about 1.3 to about 3.5 points of free acid.

4. A process according to claim 3, wherein the liquid used in step (I) comprises:

(i) an amount of a component of fluorine-containing-gas-generating material that, when tested in isolation at 529° C., is in equilibrium with a total partial pressure from about 0.02 to about 1.0 bars of one or more fluorine containing gases;

(ii.A.1) an amount, constituted of distinct amounts of sodium cations and carboxylate anions, that is from about 17 to about 80 g/l of a component of sodium salt(s) of organic monocarboxylic aliphatic acids having from 16 to 20 carbon atoms per molecule;

(ii.A.2) an amount, constituted of distinct amounts of lithium cations and carboxylate anions, of a component of lithium salt(s) of organic monocarboxylic aliphatic acids having from 16 to 20 carbon atoms per molecule, said amount of a component of lithium salts having a molar ratio to the amount of sodium salts recited in part (ii.A.1) above that is from about 0.10:1.0 to about 0.5:1.0;

(ii.B) an amount, constituted of distinct amounts of calcium cations and carboxylate anions, of a component of calcium salt(s) of monocarboxylic aliphatic acids having from 16 to 20 carbon atoms per molecule, said amount of carboxylate anions in said calcium salts having a ratio to a total of the carboxylate anions amounts of components (ii.A.1) and (ii.A.2) that is from about 0.12:1.0 to about 0.70:1.0;

(ii.C) an amount, having a stoichiometric equivalent as boron atoms, of a component of salt(s) of inorganic acids containing boron, oxygen, and hydrogen as sole elemental constituents, said stoichiometric equivalent as boron atoms of said amount having a ratio to a sum of the amounts of components (ii.A.1) and (ii.A.2) that is from about 0.030:1.0 to about 0.25:1.0; and (ii.D) an amount of a component of free monocarboxylic aliphatic acids having from 16 to 20 carbon atoms per molecule, said amount having a ratio to a total of the carboxylate anions amounts of components (ii.A.1) and (ii.A.2) that is from about 0.0010:1.0 to about 0.30:1.0, and, in said liquid used in step (I), the amount of fluorine-containing-gas-generating material has a ratio to a sum of the amounts of components (ii.A) and (ii.B) that is from about 0.0013:1.0 to about 0.025:1.0 and there are from about 1.6 to about 3.3 points of free acid.

5. A process according to claim 4, wherein, in said liquid used in step (I): there are from about 1.9 to about 3.1 points of free acid; the fluorine-containing-gas-generating material, when tested in isolation at 529° C., is in equilibrium with a total partial pressure from about 0.04 to about 0.6 bars of one or more fluorine containing gases; the amount of component (ii.A.1) is from about 25 to about 60 g/l; the amount of component (ii.A.2) has a molar ratio to the amount of sodium salts recited in part (ii.A.1) that is from about 0.14:1.0 to about 0.40:1.0; the amount of carboxylate anions in component (ii.B) has a ratio to the total of the carboxylate anions amounts of components (ii.A.1) and (ii.A.2) that is from about 0.16:1.0 to about 0.50:1.0; the stoichiometric equivalent as boron atoms from component (ii.C) has a ratio to the sum of the amounts of components (ii.A.1) and (ii.A.2) that is from about 0.030:1.0 to about 0.25:1.0; the amount of component (ii.D) has a ratio to the total of the carboxylate anions amounts of components (ii.A.1) and (ii.A.2) that is from about 0.0030:1.0 to about 0.060:1.0; and the amount of fluorine-containing-gas-generating material has a ratio to a sum of the amounts of components (ii.A) and (ii.B) that is from about 0.0016:1.0 to about 0.010:1.0.

6. A process according to claim 5, wherein, in said liquid used in step (I): there are from about 2.3 to about 2.9 points of free acid; the fluorine-containing-gas-generating material, when tested in isolation at 529° C., is in equilibrium with a total partial pressure from about 0.08 to about 0.4 bars of one or more fluorine containing gases; the amount of component (ii.A.1) is from about 31 to about 45 g/l; the amount of component (ii.A.2) has a molar ratio to the amount of sodium salts recited in part (ii.A.1) that is from about 0.160:1.0 to about 0.27:1.0; the amount of carboxylate anions in component (ii.B) has a ratio to the total of the carboxylate anions amounts of components (ii.A.1) and (ii.A.2) that is from about 0.20:1.0 to about 0.33:1.0; the stoichiometric equivalent as boron atoms from component (ii.C) has a ratio to the sum of the amounts of components (ii.A.1) and (ii.A.2) that is from about 0.035:1.0 to about 0.080:1.0; the amount of component (ii.D) has a ratio to the total of the carboxylate anions amounts of components (ii.A.1) and (ii.A.2) that is from about 0.0090:1.0 to about 0.020:1.0; and the amount of fluorine-containing-gas-generating material has a ratio to a sum of the amounts of components (ii.A) and (ii.B) that is from about 0.0019:1.0 to about 0.50:1.0.

7. A process according to claim 1, wherein the liquid used in step (I) comprises:

(i) an amount of sodium fluoroborate;

(ii.A.1) an amount, constituted of distinct amounts of sodium cations and carboxylate anions, that is from about 13 to about 120 g/l of a component of sodium salt(s) of organic monocarboxylic aliphatic acids having from 10 to 22 carbon atoms per molecule;

(ii.A.2) an amount, constituted of distinct amounts of lithium cations and carboxylate anions, of a component of lithium salt(s) of organic monocarboxylic aliphatic acids having from 10 to 22 carbon atoms per molecule, said amount of a component of lithium salt(s) having a molar ratio to the amount of sodium salts recited in part (ii.A.1) above that is from about 0.080:1.0 to about 1.0:1.0;

(ii.B) an amount, constituted of distinct amounts of calcium cations and carboxylate anions, of a component of calcium salt(s) of monocarboxylic aliphatic acids having from 10 to 22 carbon atoms per molecule, said amount of carboxylate anions in said calcium salt(s) having a ratio to a total of the carboxylate anions amounts of components (ii.A.1) and (ii.A.2) that is from about 0.10:1.0 to about 0.80:1.0; and (ii.C) an amount, having a stoichiometric equivalent as boron atoms, of a component of salt(s) of inorganic acids containing boron, oxygen, and hydrogen as sole elemental constituents, said stoichiometric equivalent as boron atoms of said amount having a ratio to a sum of the amounts of components (ii.A.1) and (ii.A.2) that is from about 0.020:1.0 to about 0.40:1.0;

and, in said liquid used in step (I), the amount of sodium fluoroborate has a ratio to a sum of the amounts of components (ii.A) and (ii.B) that is from about 0.0010:1.0 to about 0.05:1.0 and there are from about 1.6 to about 3.5 points of free acid.

8. A process according to claim 7, wherein the liquid used in step (I) comprises:

(i) an amount of sodium fluoroborate;

(ii.A.1) an amount, constituted of distinct amounts of sodium cations and carboxylate anions, that is from about 17 to about 80 g/l of a component of sodium salt(s) of organic monocarboxylic aliphatic acids having from 16 to 20 carbon atoms per molecule;

(ii.A.2) an amount, constituted of distinct amounts of lithium cations and carboxylate anions, of a component of lithium salt(s) of organic monocarboxylic aliphatic acids having from 16 to 20 carbon atoms per molecule, said amount of a component of lithium salt(s) having a molar ratio to the amount of sodium salts recited in part (ii.A.1) that is from about 0.10:1.0 to about 0.5:1.0;

(ii.B) an amount, constituted of distinct amounts of calcium cations and carboxylate anions, of a component of calcium salt(s) of monocarboxylic aliphatic acids having from 16 to 20 carbon atoms per molecule, said amount of carboxylate anions in said calcium salt(s) having a ratio to a total of the carboxylate anions amounts of components (ii.A.1) and (ii.A.2) that is from about 0.12:1.0 to about 0.70:1.0;

(ii.C) an amount, having a stoichiometric equivalent as boron atoms, of a component of salt(s) of inorganic acids containing boron, oxygen, and hydrogen as sole elemental constituents, said stoichiometric equivalent as boron atoms of said amount having a ratio to a sum of the amounts of components (ii.A.1) and (ii.A.2) that is from about 0.030:1.0 to about 0.25:1.0; and (ii.D) an amount of a component of free monocarboxylic aliphatic acids having from 16 to 20 carbon atoms per molecule, said amount having a ratio to a total of the carboxylate anions amounts of components (ii.A.1) and (ii.A.2) that is from about 0.0010:1.0 to about 0.30:1.0, and, in said liquid used in step (I), the amount of sodium fluoroborate has a ratio to a sum of the amounts of components (ii.A) and (ii.B) that is from about 0.0013:1.0 to about 0.025:1.0 and there are from about 1, to about 3.3 points of free acid.

9. A process according to claim 8, wherein, in said liquid used in step (I): there are from about 2.1 to about 3.1 points of free acid; the amount of component (ii.A.1) is from about 25 to about 60 g/l; the amount of component (ii.A.2) has a molar ratio to the amount of component (ii.A.1) that is from about 0.14:1.0 to about 0.40:1.0; the amount of carboxylate anions in component (ii.B) has a ratio to the total of the carboxylate anions amounts of components (ii.A.1) and (ii.A.2) that is from about 0.16:1.0 to about 0.50:1.0; the stoichiometric equivalent as boron atoms from component (ii.C) has a ratio to the sum of the amounts of components (ii.A.1) and (ii.A.2) that is from about 0.030:1.0 to about 0.25:1.0; the amount of component (ii.D) has a ratio to the total of the carboxylate anions amounts of components (ii.A.1) and (ii.A.2) that is from about 0.0030:1.0 to about 0.060:1.0; and the amount of sodium fluoroborate has a ratio to a sum of the amounts of components (ii.A) and (ii.B) that is from about 0.0016:1.0 to about 0.010:1.0.

10. A process according to claim 9, wherein, in said liquid used in step (I): there are from about 2.3 to about 2.9 points of free acid; component (ii.A.1) is sodium stearate; the amount of component (ii.A.1) is from about 31 to about 45 g/l; component (ii.A.2) is lithium stearate; the amount of component (ii.A.2) has a molar ratio to the amount of component (ii.A.1) that is from about 0.160:1.0 to about 0.27:1.0; component (ii.B) is calcium stearate; the amount of carboxylate anions in component (ii.B) has a ratio to the total of the carboxylate anions amounts of components (ii.A.1) and (ii.A.2) that is from about 0.20:1.0 to about 0.33:1.0; component (ii.C) is sodium tetraborate; the stoichiometric equivalent as boron atoms from component (ii.C) has a ratio to the sum of the amounts of components (ii.A.1) and (ii.A.2) that is from about 0.035:1.0 to about 0.080:1.0; component (ii.D) is stearic acid; the amount of component (ii.D) has a ratio to the total of the carboxylate anions amounts of components (ii.A.1) and (ii.A.2) that is from about 0.0090:1.0 to about 0.020:1.0; and the amount of sodium fluoroborate has a ratio to the sum of the amounts of components (ii.A) and (ii.B) that is from about 0.0019:1.0 to about 0.0035:1.0.

* * * * *